US006758308B1

(12) United States Patent
Hearting et al.

(10) Patent No.: US 6,758,308 B1
(45) Date of Patent: Jul. 6, 2004

(54) FUNNEL ASSEMBLY

(75) Inventors: Rick Hearting, 1331 SW. 1000, Montrose, MO (US) 64770; Linda Hearting, Montrose, MO (US)

(73) Assignee: Rick Hearting, Montrose, MO (US)

( * ) Notice: Subject to any disclaimer, the term of this patent is extended or adjusted under 35 U.S.C. 154(b) by 195 days.

(21) Appl. No.: 10/194,888

(22) Filed: Jul. 12, 2002

(51) Int. Cl.[7] ..... F01M 11/04

(52) U.S. Cl. ..... 184/105.1; 184/1.5; 141/331; 222/113; 362/161

(58) Field of Search ..... 184/1.5, 105.1, 184/65; 141/331; 222/113; 362/96, 161, 154, 253

(56) References Cited

U.S. PATENT DOCUMENTS 2,252,267 A * 8/1941 Lofgren ..... 439/700
2,547,450 A * 4/1951 Dupont ..... 222/113
2,577,857 A 12/1951 Parisotto
3,939,884 A * 2/1976 Mader ..... 141/333
4,155,167 A 5/1979 DeLano
4,733,937 A 3/1988 Lia et al.
5,511,595 A * 4/1996 Stidham ..... 141/300
5,535,793 A 7/1996 Tantre
D375,878 S 11/1996 Morris
5,960,907 A 10/1999 Chau
6,276,410 B1 * 8/2001 Esmeralda ..... 141/332

* cited by examiner

*Primary Examiner*—Chong H. Kim

(57) ABSTRACT

A funnel includes a housing that has a perimeter wall for defining an interior space. An attachment assembly is coupled to the housing. The attachment assembly is for stabilizing the housing to a support surface of a vehicle. The housing includes a receiving portion for securely receiving a container of lubricant. The housing includes a directing portion that is in fluid communication with the receiving portion for facilitating the flow of lubricant from the receiving portion to the directing portion into an engine of a vehicle. The housing includes a handle portion that is coupled to the receiving portion for facilitating gripping of the housing by the hand of a user. A light assembly is positioned proximate the handle portion of the housing. The light assembly is for providing light to a distal end of the housing allowing the user to easily position the funnel assembly in low light conditions.

12 Claims, 3 Drawing Sheets

FUNNEL ASSEMBLY

BACKGROUND OF THE INVENTION

1. Field of the Invention

The present invention relates to funnels and more particularly pertains to a new funnel assembly for providing a user with a better funnel for adding oil and other fluids to engines.

2. Description of the Prior Art

The use of funnels is known in the prior art. U.S. Pat. No. 2,577,857 describes a combination oil can and light for providing a light that is focused on the end of the spout. Another type of funnel is U.S. Pat. No. 4,155,167 describing a dipstick guide for measuring the level of oil in the crankcase of an engine. U.S. Pat. No. 5,960,907 describes an oil changing system for draining dirty oil from the drain plug of the oil pan of the motor vehicle and then using the same device for filling the motor vehicle engine with clean oil. U.S. Pat. No. 4,733,937 describes an optical illuminating system for endoscope having a round fiber optic bundle light guide and a non-spherical lens disposed at the distal end of the light guide. U.S. Pat. No. 5,535,793 describes a permanent flexible oil filler funnel adapted to engage the oil filler port on and internal combustion engine. U.S. Pat. No. 375,878 describes an ornamental design for a funnel.

SUMMARY OF THE INVENTION

The object of the present invention is to provide a new funnel assembly that would be easier to position the present invention where it was needed, and in a pinch, the product could even be used like a flashlight for other applications.

Another object of the present invention is to provide a new funnel assembly that would include a clamp and magnet member allowing the user to secure the present invention in an upright position and keep it from tipping over while in use.

To this end, the present invention generally comprises a housing that has a perimeter wall for defining an interior space. An attachment assembly is coupled to the housing. The attachment assembly is for stabilizing the housing to a support surface of a vehicle. The housing includes a receiving portion for securely receiving a container of lubricant. The housing includes a directing portion that is in fluid communication with the receiving portion for facilitating the flow of lubricant from the receiving portion to the directing portion into an engine of a vehicle. The housing includes a handle portion that is coupled to the receiving portion for facilitating gripping of the housing by the hand of a user. A light assembly is positioned proximate the handle portion of the housing. The light assembly is for providing light to a distal end of the housing allowing the user to easily position the funnel assembly in low light conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
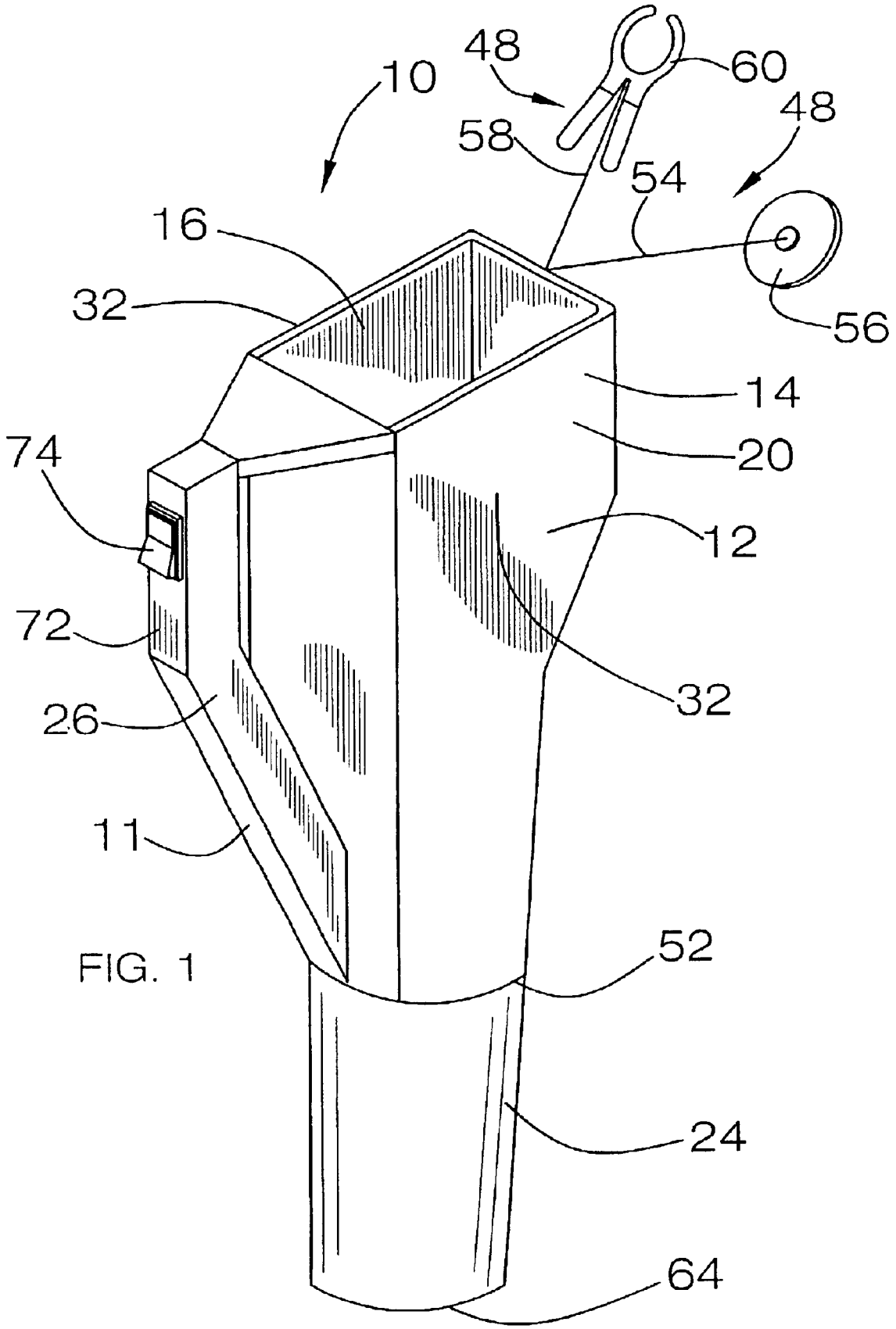
FIG. 1 is a perspective view of a new funnel assembly according to the present invention.
Figure 2:
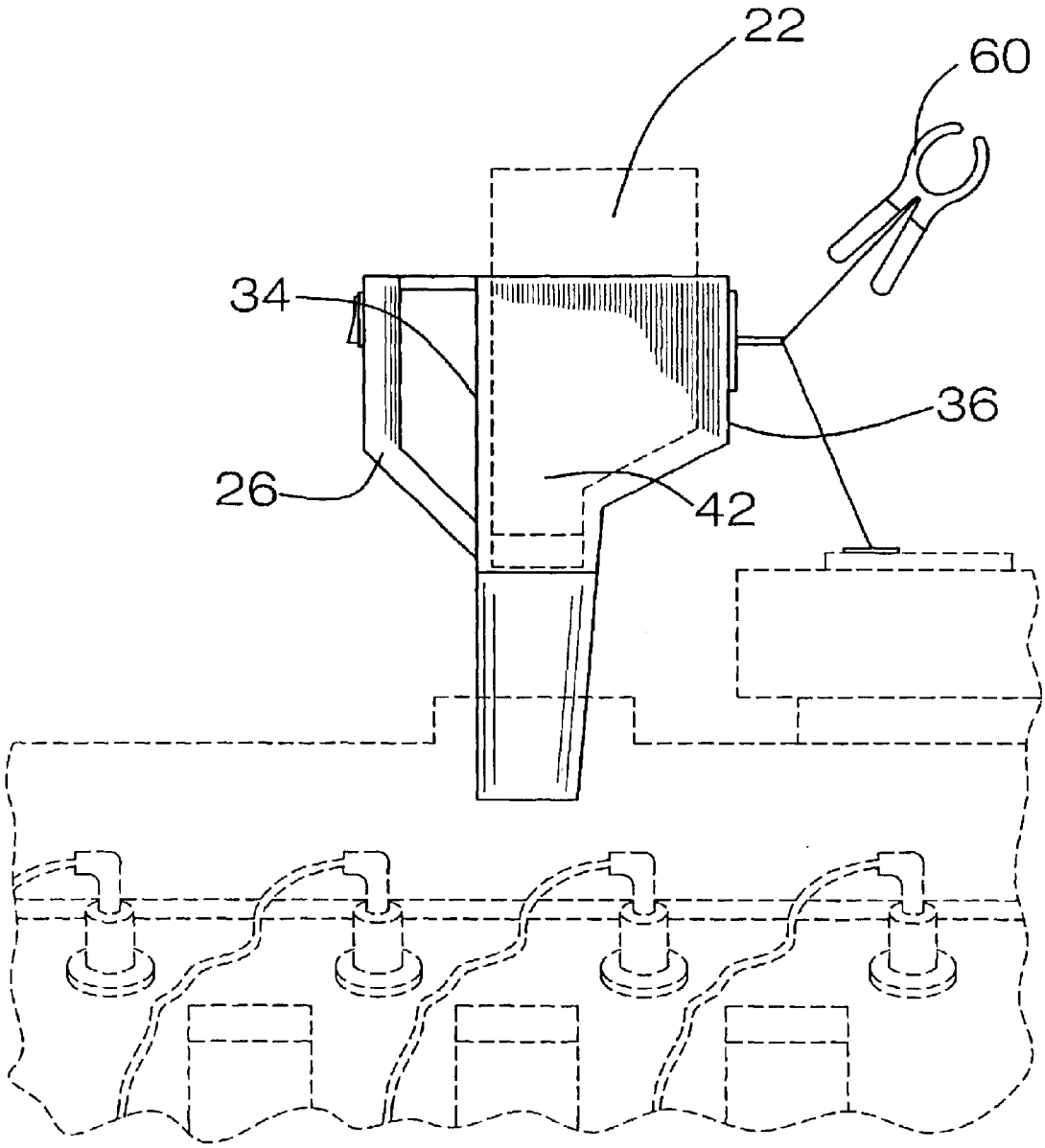
FIG. 2 is a side view of the present invention.
Figure 3:
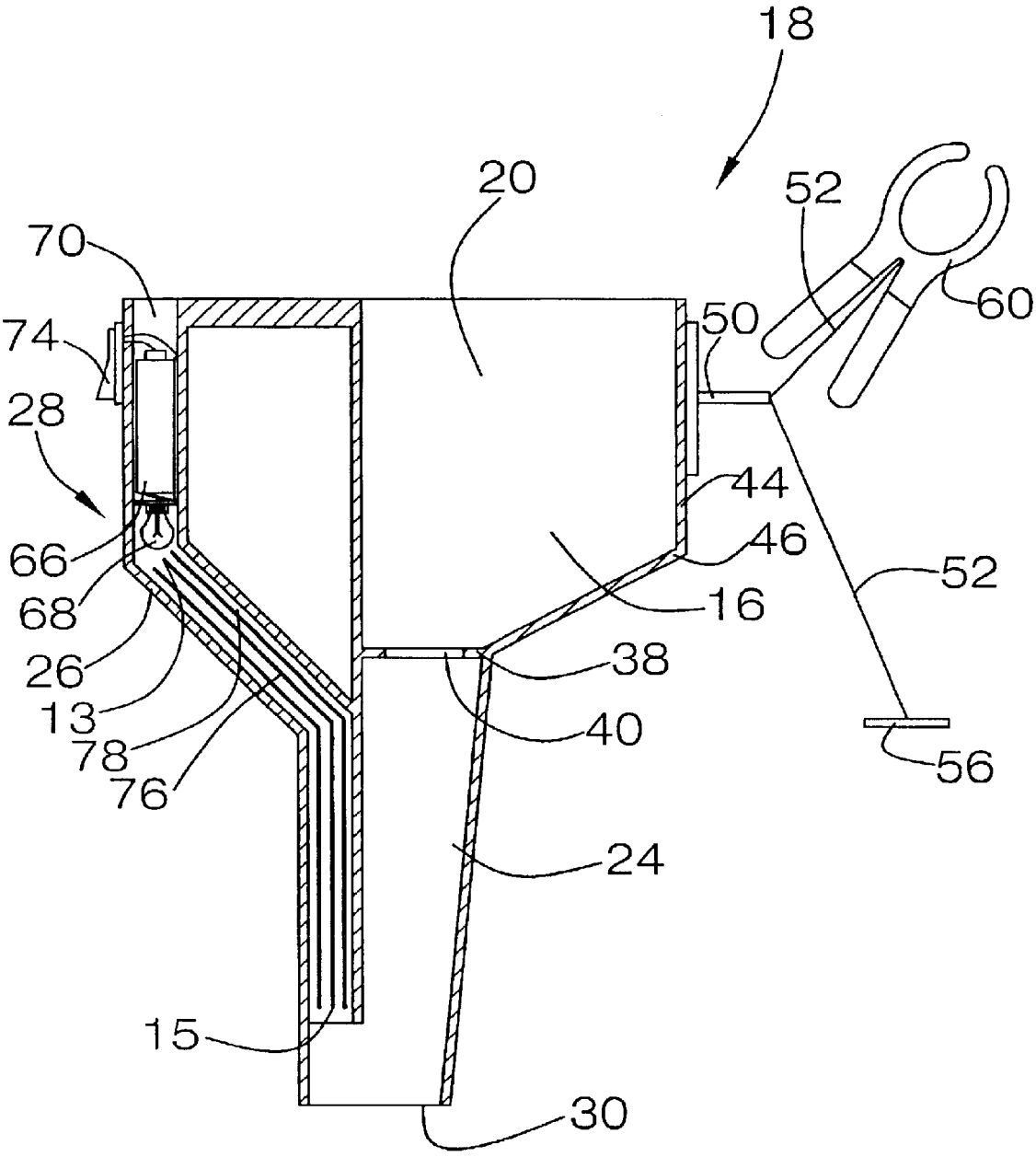
FIG. 3 is a cross-sectional view of the present invention.

With reference now to the drawings, and in particular to FIGS. 1 through 3 thereof, a new funnel assembly embodying the principles and concepts of the present invention and generally designated by the reference numeral 10 will be described.

As best illustrated in FIGS. 1 through 3, the funnel assembly 10 generally comprises a housing 12 that has a perimeter wall 14 for defining an interior space 16. An attachment assembly 18 is coupled to the housing 12. The attachment assembly 18 is for stabilizing the housing 12 to a support surface of a vehicle. The housing 12 includes a receiving portion 20 for securely receiving a container of lubricant 22. The housing 12 includes a directing portion 24 that is in fluid communication with the receiving portion 20 for facilitating the flow of lubricant from the receiving portion 20 to the directing portion 24 into an engine 2 of a vehicle. The housing 12 includes a handle portion 26 that is coupled to the receiving portion 20 for facilitating gripping of the housing 12 by the hand of a user. A light assembly 28 is positioned proximate the handle portion 26 of the housing 12. The light assembly 28 is for providing light to a distal end 30 of the housing 12 allowing the user to easily position the funnel assembly 10 in low light conditions.

The receiving portion 20 has an opening for facilitating insertion of a lubricant container 22. The receiving portion 20 has a pair of side walls 32, a first end wall 34 and a second end wall 36. The first end wall 34 is positioned near the handle portion 26 of the housing 12. The second end wall 36 is positioned opposite the first end wall 34. The receiving portion 20 has a bottom wall 38 positioned opposite the opening of the receiving portion 20.

The bottom wall 38 has an aperture 40 for receiving the neck 42 of a lubricant container 22.

The second end wall 36 has a first extent 44 and a second extent 46. The first extent 44 of the second end wall 36 is positioned substantially parallel with the first end wall 34. The second extent 46 of the second end wall 36 extends between the first extent 44 of the second end wall 36 and a receiving portion 20 such that the second extent 46 is angled toward the first end wall 34. The second extent 46 is designed for supporting an angled surface of a lubricant container 22.

The attachment assembly 48 includes a mounting portion 50 and a plurality of coupling portions 52. The mounting portion 50 is coupled to the receiving portion 20. Each of the coupling portions 52 is coupled to the mounting portion 50. Each of the coupling portions 52 are designed to be coupled to the support surface of the vehicle for stabilizing the housing 12.

One of the coupling portions 52 include a connecting member 54 and a magnet member 56. The connecting member 54 is coupled to the mounting portion 50. The magnet member 56 is coupled to the connecting member 54 opposite the mounting portion 50. The magnet member 56 is designed for magnetically coupling to a support surface.

A second of the coupling portions 58 includes a connecting member 54 and a clip member 60. The connecting member 54 is coupled to the mounting portion 50. The clip member 60 is coupled to the connecting member 54 opposite the mounting portion 50. The clip member 60 is designed to be clipped to a support surface.

The directing portion 24 has a first end 62 and a second end 64. The first end 62 is coupled to the receiving portion 20. The second end 64 of the directing portion 24 is for inserting into a lubricant opening of a motor vehicle.

The lighting assembly 28 includes a power supply 66 that is operationally coupled to a light member 68. The power supply 66 is positioned in the interior space 70 of a first extent 72 of the handle portion 26. The power supply 66 is for providing a power to the light member 68. The lighting assembly 28 further includes a switch member 74. The switch member 74 is integrally coupled to an outer surface of the first extent 72 of the handle portion 26. The switch member 74 is operationally coupled between the power supply 66 and the light member 68 for controlling power from the power supply 66 to the light member 68.

A lighting assembly 28 further includes a plurality of light transferring members 76. The light transferring members 76 are positioned in an interior space 78 of a second extent 11 of the handle portion 20. Each of the light transferring members 76 is constructed of a translucent material such that light from the light member 68 is directed from a first end 13 of each of the light transferring members 76 to a second end 15 of the associated one of the light transferring members 76. Each of the light transferring members 76 is for directing light towards the distal end 30 of the housing 12.

In use, the user would insert a conventional oil bottle in the receiving portion of the housing. The bottom wall of the receiving portion would also be wider than that of a conventional funnel, to accommodate the top of an inverted oil bottle. Oil would flow from the receiving portion to the directing portion and into the opening of an engine of a motor vehicle. The light assembly would provide the user with a light that could be used to position the present invention in low light conditions. A pair of coupling portions would allow the user to securely anchor the present invention to a support surface of a motor vehicle.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A funnel assembly for use in pouring oil in a motor vehicle comprising:

a housing having a perimeter wall defining an interior space;

an attachment assembly being coupled to said housing, said attachment assembly being for stabilizing said housing to a support surface of a vehicle;

said housing comprising a receiving portion for securely receiving a container of lubricant;

said housing comprising a directing portion being in fluid communication with said receiving portion for facilitating the flow of lubricant from said receiving portion to said directing portion into an engine of a vehicle;

said housing comprising a handle portion being coupled to said receiving portion for facilitating gripping of said housing by the hand of a user;

a light assembly being positioned proximate said handle portion of said housing, said light assembly being for providing light to a distal end of said housing allowing the user to easily position the funnel assembly in low light conditions.

2. The assembly of claim 1, wherein said receiving portion has an opening for facilitating insertion of a lubricant container, said receiving portion having a pair of side walls, a first end wall and a second end wall, said first end wall being positioned near said handle portion of said housing, said second end wall being positioned opposite said first end wall.

3. The assembly of claim 2, wherein said receiving portion has a bottom wall positioned opposite said opening of said receiving portion, said bottom wall having an aperture for receiving the neck of a lubricant container.

4. The assembly of claim 2, wherein said second end wall having a first extent and a second extent, said first extent of said second end wall being positioned substantially parallel with said first end wall, said second extent of said second wall extending between said first extent of said second end wall and a receiving portion such that said second extent is angled toward said first end wall, said second extent being adapted for supporting an angled surface of a lubricant container.

5. The assembly of claim 1, wherein said attachment assembly comprising a mounting portion and a plurality of coupling portions, said mounting portion being coupled to said receiving portion, each of said coupling portions being coupled to said mounting portion, each of said coupling portions being adapted for being coupled to the support surface of the vehicle for stabilizing the housing.

6. The assembly of claim 5, wherein one of said coupling portions comprises a connecting member and a magnet member, said connecting member being coupled to said mounting portion, said magnet member being coupled to said connecting member opposite said mounting portion, said magnet member being adapted for magnetically coupling to a support surface.

7. The assembly of claim 5, wherein a second of said coupling portions comprises a connecting member and a clip member, said connecting member being coupled to said mounting portion, said clip member being coupled to said connecting member opposite said mounting portion, said clip member being adapted for being clipped to a support surface.

8. The assembly of claim 1, wherein said directing portion has a first end and a second end, said first end being coupled to said receiving portion, said second end of said directing portion being for inserting into a lubricant opening of a motor vehicle.

9. The assembly of claim 1, wherein said lighting assembly comprises a power supply being operationally coupled to a light member, said power supply being positioned in said interior space of a first extent of said handle portion, said power supply being for providing a power to said light member.

10. The assembly of claim 9, wherein a lighting assembly further comprising a switch member, said switch member being integrally coupled to an outer surface of said first extent of said handle portion, said switch member being operationally coupled between said power supply and said light member for controlling power from said power supply to said light member.

11. The assembly of claim 9, wherein a lighting assembly further comprises a plurality of light transferring members, said light transferring members being positioned in an interior space of a second extent of said handle portion, each of said light transferring members being constructed of a translucent material such that light from said light member is directed from a first end of each of said light transferring members to a second end of the associated one of said light transferring members, each of said light transferring members, each of said light transferring members being for directing light towards said distal end of said housing.

12. A funnel assembly for use in pouring oil in a motor vehicle comprising:

a housing having a perimeter wall defining an interior space;

an attachment assembly being coupled to said housing, said attachment assembly being for stabilizing said housing to a support surface of a vehicle;

said housing comprising a receiving portion for securely receiving a container of lubricant;

said housing comprising a directing portion being in fluid communication with said receiving portion for facilitating the flow of lubricant from said receiving portion to said directing portion into an engine of a vehicle;

said housing comprising a handle portion being coupled to said receiving portion for facilitating gripping of said housing by the hand of a user;

a light assembly being positioned proximate said handle portion of said housing, said light assembly being for providing light to a distal end of said housing allowing the user to easily position the funnel assembly in low light conditions;

wherein said receiving portion has an opening for facilitating insertion of a lubricant container, said receiving portion having a pair of side walls, a first end wall and a second end wall, said first end wall being positioned near said handle portion of said housing, said second end wall being positioned opposite said first end wall;

wherein said receiving portion has a bottom wall positioned opposite said opening of said receiving portion, said bottom wall having an aperture for receiving the neck of a lubricant container;

wherein said second end wall having a first extent and a second extent, said first extent of said second end wall being positioned substantially parallel with said first end wall, said second extent of said second wall extending between said first extent of said second end wall and a receiving portion such that said second extent is angled toward said first end wall, said second extent being adapted for supporting an angled surface of a lubricant container;

wherein said attachment assembly comprising a mounting portion and a plurality of coupling portions, said mounting portion being coupled to said receiving portion, each of said coupling portions being coupled to said mounting portion, each of said coupling portions being adapted for being coupled to the support surface of the vehicle for stabilizing the housing;

wherein one of said coupling portions comprises a connecting member and a magnet member, said connecting member being coupled to said mounting portion, said magnet member being coupled to said connecting member opposite said mounting portion, said magnet member being adapted for magnetically coupling to a support surface;

wherein a second of said coupling portions comprises a connecting member and a clip member, said connecting member being coupled to said mounting portion, said clip member being coupled to said connecting member opposite said mounting portion, said clip member being adapted for being clipped to a support surface;

wherein said directing portion has a first end and a second end, said first end being coupled to said receiving portion, said second end of said directing portion being for inserting into a lubricant opening of a motor vehicle;

wherein said lighting assembly comprises a power supply being operationally coupled to a light member, said power supply being positioned in said interior space of a first extent of said handle portion, said power supply being for providing a power to said light member;

wherein a lighting assembly further comprising a switch member, said switch member being integrally coupled to an outer surface of said first extent of said handle portion, said switch member being operationally coupled between said power supply and said light member for controlling power from said power supply to said light member; and wherein a lighting assembly further comprises a plurality of light transferring members, said light transferring members being positioned in an interior space of a second extent of said handle portion, each of said light transferring members being constructed of a translucent material such that light from said light member is directed from a first end of each of said light transferring members to a second end of the associated one of said light transferring members, each of said light transferring members, each of said light transferring members being for directing light towards said distal end of said housing.

* * * * *